US007852271B2

(12) United States Patent
Grunig et al.

(10) Patent No.: US 7,852,271 B2
(45) Date of Patent: Dec. 14, 2010

(54) WIRELESS FIELD DEVICE WITH ANTENNA FOR INDUSTRIAL LOCATIONS

(75) Inventors: Christina A. Grunig, Chanhassen, MN (US); Chad McGuire, Minneapolis, MN (US)

(73) Assignee: Rosemount Inc., Eden Prairie, MN (US)

( * ) Notice: Subject to any disclaimer, the term of this patent is extended or adjusted under 35 U.S.C. 154(b) by 0 days.

(21) Appl. No.: 11/904,837

(22) Filed: Sep. 28, 2007

(65) Prior Publication Data

US 2008/0079641 A1 Apr. 3, 2008

Related U.S. Application Data

(60) Provisional application No. 60/847,901, filed on Sep. 28, 2006.

(51) Int. Cl.
*H01Q 1/24* (2006.01)

(52) U.S. Cl. ..... 343/702; 343/901; 343/872

(58) Field of Classification Search ..... 343/901, 343/702, 872
See application file for complete search history.

(56) References Cited

U.S. PATENT DOCUMENTS

| | | | | |
|---|---|---|---|---|
| 4,435,713 | A * | 3/1984 | Gasparaitis et al. | 343/702 |
| 5,049,896 | A | 9/1991 | Conley | 343/888 |
| 5,392,056 | A | 2/1995 | DeTeso et al. | 343/873 |
| 5,403,197 | A | 4/1995 | Ernst et al. | 439/165 |
| 5,808,585 | A | 9/1998 | Frenzer et al. | 343/872 |
| 5,907,306 | A * | 5/1999 | Karabinis et al. | 343/702 |
| 6,005,523 | A | 12/1999 | Rudisill | 343/702 |
| 6,052,090 | A | 4/2000 | Simmons et al. | 343/702 |
| 6,166,707 | A * | 12/2000 | Painter et al. | 343/872 |
| 6,275,198 | B1 * | 8/2001 | Kenoun et al. | 343/895 |
| 6,337,671 | B1 * | 1/2002 | Lee | 343/901 |
| 7,196,671 | B2 * | 3/2007 | Chen et al. | 343/702 |
| 2002/0149537 | A1 | 10/2002 | Masahiro | 343/895 |
| 2003/0171827 | A1 * | 9/2003 | Keyes et al. | 700/19 |
| 2003/0184494 | A1 * | 10/2003 | Yagi | 343/876 |
| 2005/0110684 | A1 | 5/2005 | Liu | 343/700 |

(Continued)

FOREIGN PATENT DOCUMENTS

WO WO9726685 A 7/1997

(Continued)

OTHER PUBLICATIONS

International Search Report and Written Opinion in Application No. PCT/US2007/020913, filed Sep. 9, 2007.

(Continued)

*Primary Examiner*—Douglas W Owens
*Assistant Examiner*—Dieu Hien T Duong
(74) *Attorney, Agent, or Firm*—Christopher R. Christenson; Westman, Champlin & Kelly, P.A.

(57) ABSTRACT

A wireless field device is disclosed. The wireless field device includes an enclosure having a processor disposed within the enclosure. A power module may also be located inside the enclosure and be coupled to the processor. A wireless communication module is operably coupled to the processor and is configured to communicate using radio-frequency signals. An antenna is coupled to the wireless communication module. A radome mounted to the electronics enclosure is formed of a polymeric material. The radome has a chamber inside that contains the antenna.

16 Claims, 4 Drawing Sheets

U.S. PATENT DOCUMENTS

| | | | | |
|---|---|---|---|---|
| 2005/0208908 | A1* | 9/2005 | Karschnia et al. | 455/127.1 |
| 2006/0069208 | A1* | 3/2006 | Dhawan et al. | 525/191 |

FOREIGN PATENT DOCUMENTS

| | | | |
|---|---|---|---|
| WO | WO0008707 | A | 2/2000 |
| WO | WO2004/070878 | | 8/2004 |
| WO | WO 2005086331 | | 9/2005 |

OTHER PUBLICATIONS

Material data sheet for Valox Resin 3706, SABIC Innovative Plastics, 2007.

Material data sheet for GE Plastics VALOX 3706 PBT, http://mymatweb.com/search/SpecificMaterialPrint.asp?bassnum=PGE8NA555, 2007.

Material data sheet for Valox Resin V3900WX, SABIC Innovative Plastics, 2007.

Office Action from Russian patent application 2009115866 dated May 18, 2010.

Second Office Action from the Russian patent application No. 2009115866 dated Sep. 17, 2010.

* cited by examiner

WIRELESS FIELD DEVICE WITH ANTENNA FOR INDUSTRIAL LOCATIONS

CROSS-REFERENCE TO RELATED APPLICATION

The present application is based on and claims the benefit of U.S. provisional patent application Ser. No. 60/847,901, filed Sep. 28, 2006, the content of which is hereby incorporated by reference in its entirety.

BACKGROUND

In industrial settings, control systems are used to monitor and control inventories of industrial and chemical processes, and the like. Typically, the control system performs these functions using field devices distributed at key locations in the industrial process and coupled to the control circuitry in the control room by a process control loop. The term "field device" refers to any device that performs a function in a distributed control or process monitoring system, including all devices used in the measurement, control and monitoring of industrial processes.

Field devices are used by the process control and measurement industry for a variety of purposes. Usually, such devices have a field-hardened enclosure so that they can be installed outdoors in relatively rugged environments and are able to withstand climatological extremes of temperature, humidity, vibration, mechanical shock, et cetera. These devices also can typically operate on relatively low power. For example, field devices are currently available that receive all of their operating power from a known 4-20 mA loop.

Some field devices include a transducer. A transducer is understood to mean either a device that generates an electrical output based on a physical input or that generates a physical output based on an electrical input signal. Typically, a transducer transforms an input into an output having a different form. Types of transducers include various analytical equipment, pressure sensors, thermistors, thermocouples, strain gauges, flow transmitters, positioners, actuators, solenoids, indicator lights, and others.

Typically, each field device also includes communication circuitry that is used for communicating with a process control room, or other circuitry, over a process control loop. In some installations, the process control loop is also used to deliver a regulated current and/or voltage to the field device for powering the field device.

Traditionally, analog field devices have been connected to the control room by two-wire process control current loops, with each device being connected to the control room by a single two-wire control loop. Typically, a voltage differential is maintained between the two wires within a range of voltages from 12-45 volts for analog mode and 9-50 volts for digital mode. Some analog field devices transmit a signal to the control room by modulating the current running through the current loop to a current that is proportional to a sensed process variable. Other analog field devices can perform an action under the control of the control room by controlling the magnitude of the current through the loop. In addition to, or in the alternative, the process control loop can carry digital signals used for communication with field devices. Digital communication allows a much larger degree of communication than analog communication. Moreover, digital devices also do not require separate wiring for each field device. Field devices that communicate digitally can respond to and communicate selectively with the control room and/or other field devices. Further, such devices can provide additional signaling such as diagnostics and/or alarms.

In some installations, wireless technologies have begun to be used to communicate with field devices. Wireless operation simplifies field device wiring and setup. One particular form of wireless communication in industrial locations is known as wireless mesh networking. This is a relatively new communication technology that is proven useful for low cost, battery-powered, wireless communication in commercial measurement applications. Wireless mesh networking is generally a short-range wireless communication system that employs low-power radio-frequency communications and are generally not targeted for long distance, plant-to-plant, pad-to-pad or station-to-station communications. While embodiments of the present invention will generally be described with respect to wireless mesh networking communication, embodiments of the present invention are generally applicable to any field device that employs any form of radio-frequency communication.

In general, wireless radio-frequency communication requires the use of an antenna. In such harsh industrial settings, the antenna is a relatively fragile physical component. Moreover, should the antenna break off, communication to the field device itself may be compromised. If the antenna seal to the housing is damaged or degraded (for example by UV exposure or hydrolytic degradation) the environmental seal can fail and cause damage to the device.

Providing a rugged radio frequency antenna for use with field devices in industrial locations would provide more robust wireless field device communication and benefit the art of industrial process measurement and control.

SUMMARY

A wireless field device is disclosed. The wireless field device includes an enclosure having a processor disposed within the enclosure. A power module may also be located inside the enclosure and be coupled to the processor. A wireless communication module is operably coupled to the processor and is configured to communicate using radio-frequency signals. An antenna is coupled to the wireless communication module. A radome is mounted to the enclosure and is formed of a polymeric material. The radome has a chamber inside that contains the antenna.

DETAILED DESCRIPTION

Figure 1:
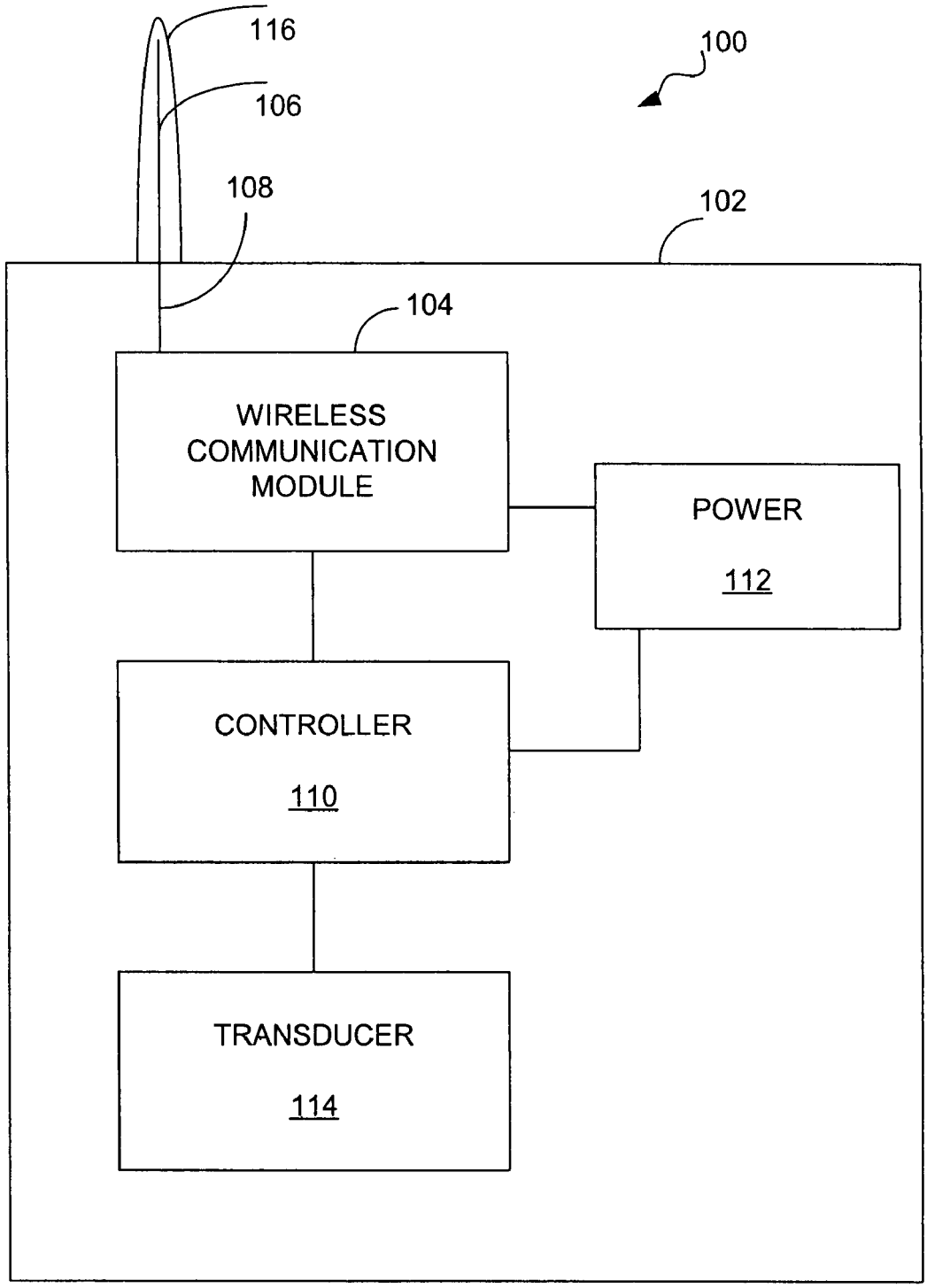
FIG. 1 is a block diagram of a wireless field device in accordance with an embodiment of the present invention.

FIG. 1 is a block diagram of a wireless field device in accordance with an embodiment of the present invention. Wireless field device 100 includes enclosure 102 illustrated diagrammatically as a rectangular box. However, the rectangular box is not intended to depict the actual shape of the enclosure 102. Wireless communication module 104 is disposed within enclosure 102 and is electrically coupled to antenna 106 via connection 108. Wireless communication module 104 is also coupled to controller 110 as well as power module 112. Wireless communication module 104 includes any suitable circuitry useful for generating radio frequency signals.

Depending on the application, wireless communication module 104 may be adapted to communicate in accordance with any suitable wireless communication protocol including, but not limited to: wireless networking technologies (such as IEEE 802.11(b) wireless access points and wireless networking devices built by Linksys of Irvine, Calif.), cellular or digital networking technologies (such as Microburst® by Aeris Communications Inc. of San Jose, Calif.), ultra wide band, global system for mobile communications (GSM), general packet radio services (GPRS), code division multiple access (CDMA), spread spectrum technology, short messaging service/text messaging (SMS), or any other suitable radio frequency wireless technology. Further, known data collision technology can be employed such that multiple field devices employing modules similar to wireless communication module 104 can coexist and operate within wireless operating range of on another. Such collision prevention can include a number of different radio-frequency channels and/or spread spectrum techniques. Additionally, communication module 104 can be a commercially available Bluetooth communication module. In the embodiment illustrated in FIG. 1, wireless communication module 104 is a component within enclosure 102 that is coupled to antenna 106.

Controller 110 is coupled to wireless communication module 104 and communicates bi-directionally with wireless communication module 104. Controller 110 is any circuit or arrangement that is able to execute one or more instructions to obtain a desired result. Preferably, controller 110 includes a microprocessor, but can also include suitable support circuitry such as onboard memory, communication busses, et cetera.

Each of wireless communication module 104 and controller 110 is coupled to power module 112. Power module 112 may preferably supply all requisite electrical energy for the operation of field device 102 to wireless communication module 104 and controller 110. Power module 112 includes any device that is able to supply stored or generated electricity to wireless communication module 104 and controller 110. Examples of devices that can comprise power module 112 include batteries (rechargeable nor not), capacitors, solar arrays, thermoelectric generators, vibration-based generators, wind-based generators, fuel cells, et cetera. Alternatively, the power module may be connected to a two-wire process control loop and obtain and store power for use by the wireless communication module.

Transducer 114 is coupled to controller 110 and interfaces field device 102 to a physical process. Examples of transducers include sensors, actuators, solenoids, indicator lights, et cetera. Essentially, transducer 114 is any device that is able to transform a signal from controller 110 into a physical manifestation, such as a valve movement, or any device that generates an electrical signal to controller 110 based upon a real world condition, such as a process fluid pressure.

Figure 2:
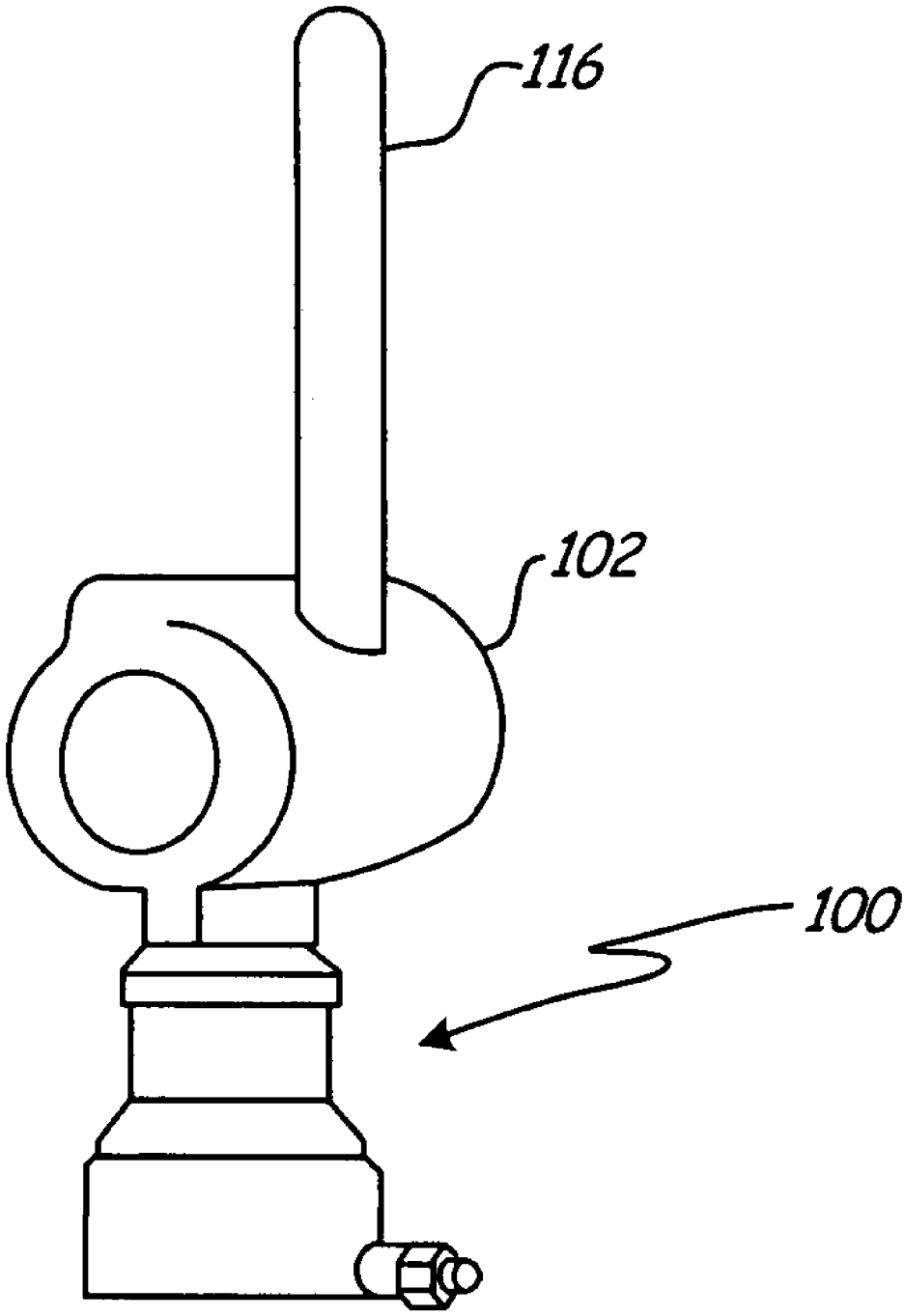
FIG. 2 is a diagrammatic view of a wireless field device in accordance with an embodiment of the present invention.

In accordance with an embodiment of the present invention antenna 106 is encased within a robust polymeric radome 116 that physically couples to enclosure 102. As used herein, a "radome" is intended to mean a housing for a radio antenna; transparent to radio waves. As such, for the purposes of this patent document, the radome need not be "dome-shaped." FIG. 2 is a diagrammatic view of field device 100 including enclosure 102 with radome 116 mounted thereon. While FIG. 2 illustrates a type of field device known as a process fluid pressure transmitter, any field device can be used. Additionally, while FIG. 2 illustrates radome 116 extending vertically above enclosure 102, radome 116 can extend in any suitable direction.

Figure 3:
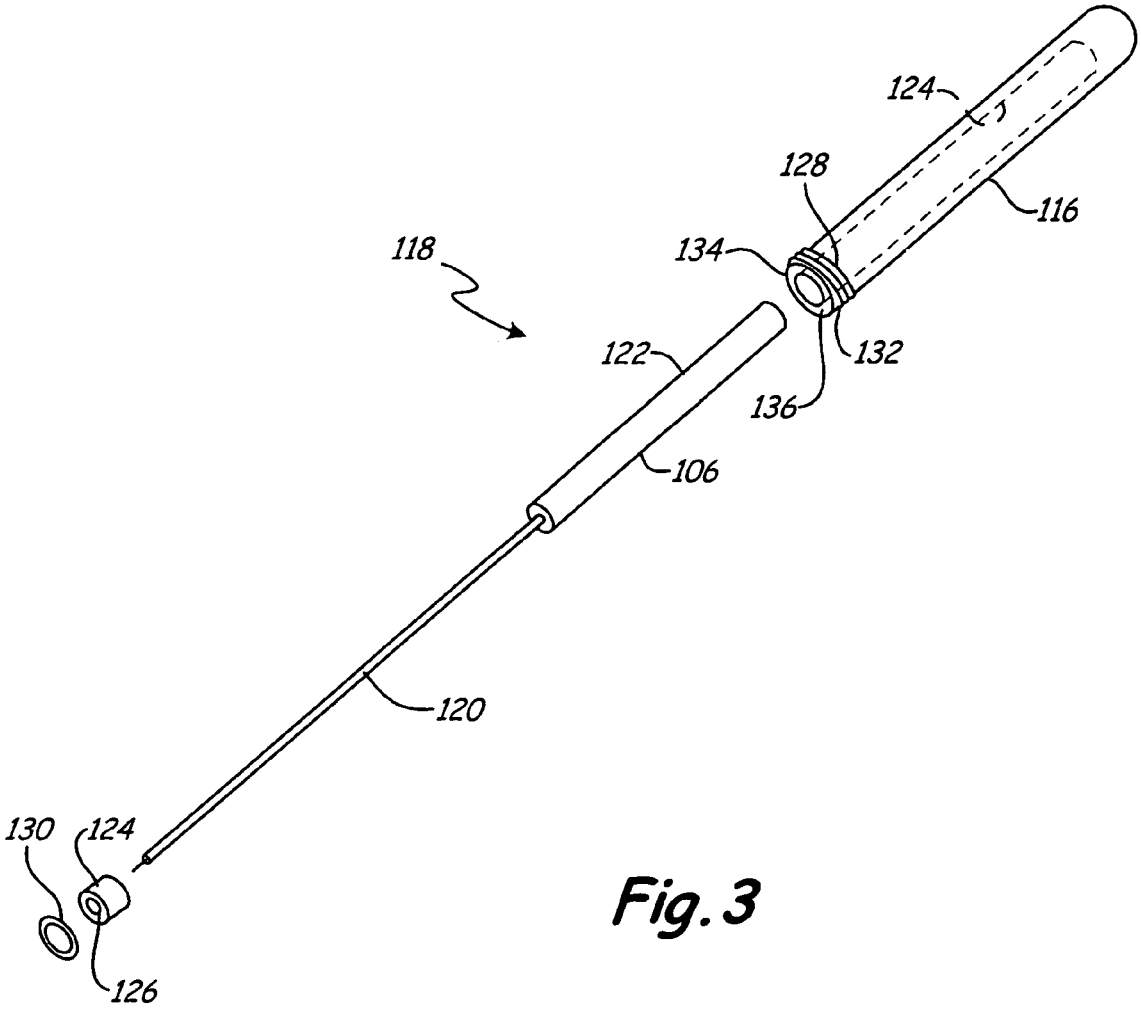
FIG. 3 is an exploded isometric view of an antenna and radome assembly in accordance with an embodiment of the present invention.

FIG. 3 is an exploded isometric view of an antenna assembly for use in industrial locations in accordance with an embodiment of the present invention. Antenna assembly 188 includes coaxial antenna 106 coupled to cable 120, which cable 120 is coupleable to wireless communication module 104 on a circuit board (not shown in FIG. 3) within housing 102. Cabling 120 may be in the form of a coaxial cable, or any other suitable arrangement. Antenna 106 has an outer diameter 122 that is sized to fit slidably within chamber 124 of radome 116. In order to fix the position of antenna 106 within radome 116 in a robust manner, a retainer 124 is preferably employed. Retainer 124 has an internal diameter 126 that is sized to slide over the outside diameter of cable 120 and press into region 128 within radome 116 in order to provide strain relief for cable 120 as well as the cable/solder joint. Additionally, adhesive can be used to provide further strain relief. O-ring 130 is also preferably used to help seal the radome-to-adapter connection from the environment. O-ring 130 is preferably an elastomeric radial O-ring, but can take any suitable form, and may be constructed from any other suitable material.

Radome 116 is formed of a relatively rigid polymer that is able to pass radio-frequency signals therethrough. Preferably, radome 116 is formed of a plastic that has a hardness of approximately 77 Shore D, has an insulation resistance that is at or less than 1 GOhm, and is capable of sustaining a 7 Joule impact after a 4 hour soak at −45 degrees Fahrenheit. One suitable example of a plastic that is well-suited for the construction of radome 116 is sold under the trade designation Valox 3706 PBT, available from SABIC Innovative Plastics of Pittsfield, Mass. However, other suitable thermoplastic resins may also be used. Thermoplastic is particularly advantageous because it is easily molded. Other suitable examples of materials that can be used to form radome 116 include Valox Resin V3900WX and Valox 357U, which are available from SABIC Innovative Plastics.

Radome 116 preferably includes an externally threaded region 132 that cooperates with an internally threaded region on housing 102 to provide a mechanical connection for antenna assembly 118. Additionally, bottom surface 134 of radome 116 preferably includes a number of locking tabs 136 that cooperate with features on housing 102 in order to prevent inadvertent loosening of the radome-to-housing connection. While tabs 136 are shown in FIG. 3, other physical arrangements that can prevent the inadvertent rotation of radome 116 can also be employed.

Figure 4:
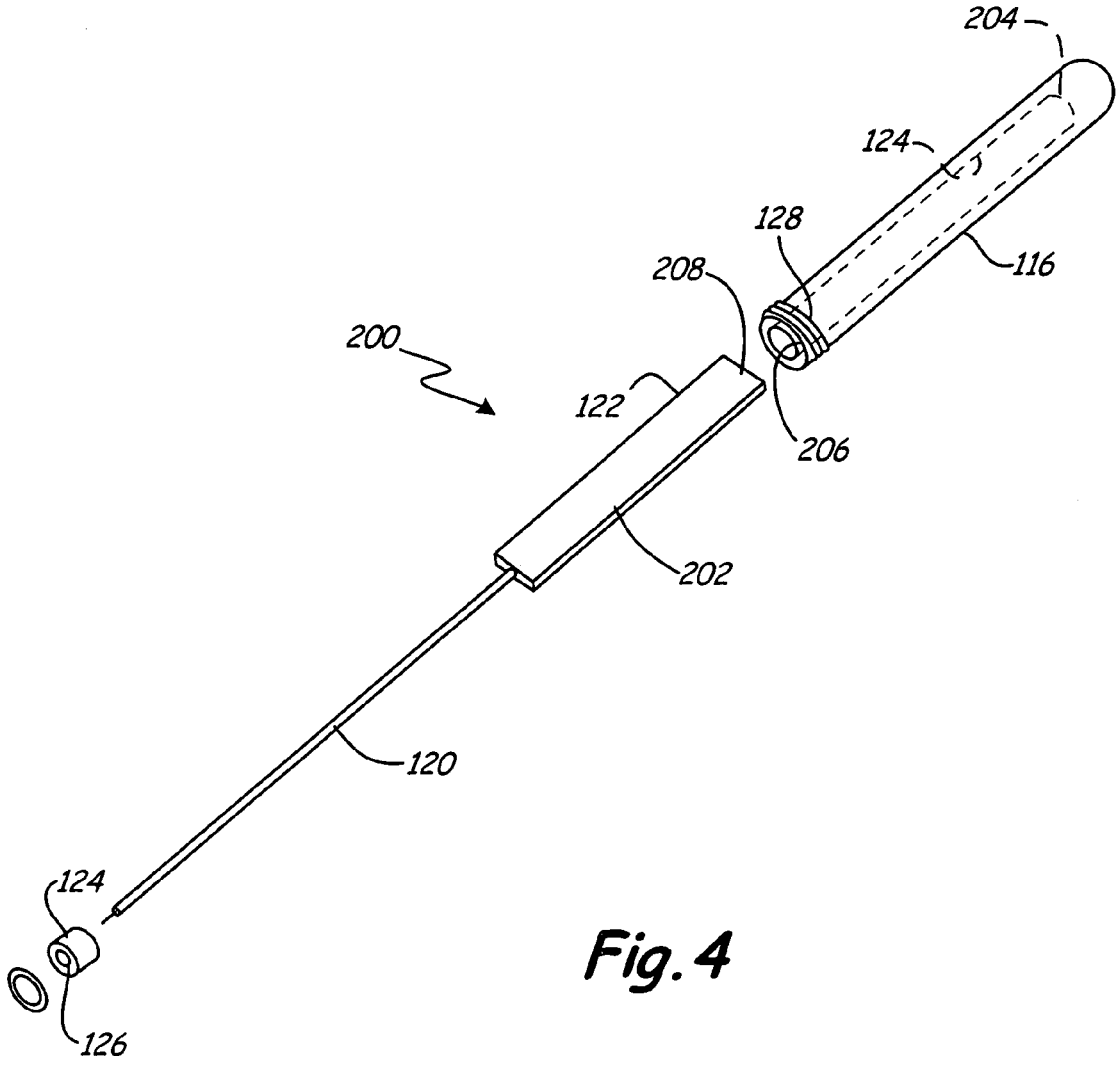
FIG. 4 is an exploded isometric view of an antenna and radome assembly in accordance with another embodiment of the present invention.

FIG. 4 is a diagrammatic view of an industrial antenna assembly in accordance with another embodiment of the present invention. Assembly 200 includes many of the same components depicted in the embodiment described with respect to FIG. 3, and like components are numbered similarly. The primary difference between the embodiments illustrated in FIGS. 3 and 4 is the form of the antenna itself. Specifically, FIG. 3 represents a coaxial style antenna, while the embodiment illustrated in FIG. 4 illustrates printed circuit board antenna 202. In the embodiment illustrated in FIG. 4, radome 116 preferably includes a slot that is sized to accept printed circuit board 202. Further, as illustrated in FIG. 4, the slot generally tapers such that the far end 204 of the slot has a width that is less than that near opening 206. This tapered slot helps create an interference fit near the end 204 with end 208 of printed circuit board antenna 202. This interference fit helps prevent relative motion of printed circuit board antenna 202 to radome 116 during vibration.

Embodiments of the present invention generally provide an antenna assembly that is suitable for the harsh environments in which field devices operate. The antenna radome is made from a polymer that is able to pass radio frequencies therethrough. Further, the radome forms part of the electronics enclosure and preferably complies with the various design criteria and specifications for field devices. Examples of desirable ratings with which the assembly may comply include, without limitation: an F1 rating by UL 746 C (weatherability); strict flammability requirements such as a V2 rating per UL 94 (UL 94, The Standard for Flammability of Plastic Materials for Parts in Devices and Appliances, which is now harmonized with IEC 60707, 60695-11-10 and 60695-11-20 and ISO 9772 and 9773); impact resistance; chemical resistance; thermal shock resistance; NEMA 4x; and IP 65.

Although the present invention has been described with reference to preferred embodiments, workers skilled in the art will recognize that changes may be made in form and detail without departing from the spirit and scope of the invention.

What is claimed is:

1. A wireless field device comprising:

a field-hardened enclosure;

a processor disposed within the field-hardened enclosure;

a power module coupled to the processor;

a wireless communication module operably coupled to the processor, the wireless communication module being configured to communicate using radio-frequency signals;

an antenna coupled to the wireless communication module;

a radome mounted to and extending from the field-hardened enclosure, the radome having a surface that cooperates with the field-hardened enclosure to prevent inadvertent rotation of the radome with respect to the field-hardened enclosure, the radome being formed of a polymeric material and having a chamber therein; and wherein the antenna is disposed within the chamber of the radome and extends outside the field-hardened enclosure.

2. The wireless field device of claim 1, wherein the power module includes a battery.

3. The wireless field device of claim 1, wherein the wireless communication module is disposed within the field-hardened enclosure.

4. The wireless field device of claim 1, wherein the antenna is a coaxial antenna.

5. The wireless field device of claim 4, and further comprising a retainer disposed over an outer diameter of cabling of the antenna, the retainer being fixedly pressed into a region within the radome to provide strain relief and vibration support.

6. The wireless field device of claim 1, wherein the antenna is a printed circuit board antenna.

7. The wireless field device of claim 6, and further comprising a retainer disposed over an outer diameter of cabling of the antenna, the retainer being fixedly pressed into a region within the radome to provide mechanical retention of the antenna and strain relief.

8. The wireless field device of claim 1, and further comprising an o-ring disposed between the field-hardened enclosure and the radome to seal the connection from an ambient environment.

9. The wireless field device of claim 1, wherein the radome is formed from a thermoplastic resin.

10. The wireless field device of claim 1, and further comprising a transducer operably coupled to the processor.

11. The wireless field device of claim 10, wherein the transducer is a process variable sensor.

12. The wireless field device of claim 10, wherein the transducer is an actuator.

13. The wireless field device of claim 1, wherein the radome is dome-shaped.

14. The wireless field device of claim 1, wherein the radome is formed of a plastic that has a hardness of approximately 77 Shore D.

15. The wireless field device of claim 1, wherein the radome is formed of a plastic that has an insulation resistance that is equal to or less than 1 GOhm.

16. The wireless field device of claim 1, wherein the surface of the radome that cooperates with the field-hardened enclosure includes a number of locking tabs.

* * * * *